US007475449B2

(12) United States Patent
Lee

(10) Patent No.: US 7,475,449 B2
(45) Date of Patent: Jan. 13, 2009

(54) VACUUM CLEANER

(75) Inventor: Jae Duck Lee, Seoul (KR)

(73) Assignee: Daewoo Electronics Corporation, Seoul (KR)

( * ) Notice: Subject to any disclaimer, the term of this patent is extended or adjusted under 35 U.S.C. 154(b) by 828 days.

(21) Appl. No.: 11/016,865

(22) Filed: Dec. 21, 2004

(65) Prior Publication Data

US 2005/0138756 A1 Jun. 30, 2005

(30) Foreign Application Priority Data

Dec. 24, 2003 (KR) ..... 10-2003-0096556
Dec. 24, 2003 (KR) ..... 10-2003-0096557
Dec. 24, 2003 (KR) ..... 10-2003-0096561
Dec. 24, 2003 (KR) ..... 10-2003-0096563

(51) Int. Cl.
*A47L 9/26* (2006.01)

(52) U.S. Cl. ..... 15/326; 15/412; 15/413

(58) Field of Classification Search ..... 15/326, 15/412, 413; *A47L 9/26*
See application file for complete search history.

(56) References Cited

U.S. PATENT DOCUMENTS 2,323,275 A * 6/1943 Lofgren ..... 15/323
4,808,090 A * 2/1989 Evans ..... 417/423.2
4,924,039 A * 5/1990 McAllise et al. ..... 191/12.2 R
5,701,631 A 12/1997 Lindquist
5,720,074 A 2/1998 Lee
6,052,862 A * 4/2000 Lowery ..... 15/323

FOREIGN PATENT DOCUMENTS

| | | |
|---|---|---|
| CN | 1159907 | 9/1997 |
| CN | 1096252 | 12/2002 |
| DE | 79 08 622 | 2/1980 |
| DE | 197 39 613 | 3/1998 |
| EP | 0 345 699 | 12/1989 |
| EP | 0 839 488 | 5/1998 |
| EP | 1 190 660 | 3/2002 |
| JP | 4-79930 | 3/1992 |
| JP | 05-049561 | 3/1993 |
| JP | 7-88060 | 4/1995 |
| JP | 2001-29276 | * 2/2001 |
| JP | 2001-087173 | 4/2001 |
| JP | 2002-209806 | 7/2002 |
| WO | 00/30521 | 6/2000 |
| WO | 01/74025 | 10/2001 |

* cited by examiner

*Primary Examiner*—David A Redding
(74) *Attorney, Agent, or Firm*—Bacon & Thomas, PLLC

(57) ABSTRACT

A vacuum cleaner includes a main body, a motor assembly installed at the main body, the motor assembly including a motor for generating a suction force, an exhaust filter for filtering fine foreign substances from air passing through the motor assembly, and a guide member for guide a portion of air going via the exhaust filter to the inside of the main body. The guide member has a horizontal guide member and a vertical guide member for guiding portions of air passing through the exhaust filter to the side and the top of the main body respectively.

10 Claims, 6 Drawing Sheets

VACUUM CLEANER

FIELD OF THE INVENTION

The present invention relates to a vacuum cleaner capable of cooling various heating elements installed therein and reducing the noise by diverging a flow of an air passing through air outlets for discharging an internal air of the vacuum cleaner outside.

BACKGROUND OF THE INVENTION

A vacuum cleaner is an appliance for removing foreign materials such as dirt, dust and debris by using a strong suction force generated by a motor assembly. The vacuum cleaner includes a cooling system for cooling a heating element, e.g., an electrical cord installed therein preferably.

Referring to FIG. 1, there is shown one of such prior art vacuum cleaners disclosed in U.S. Pat. No. 6,611,989 entitled "VACUUM CLEANER HAVING COOLING FEATURES". As shown, the conventional vacuum cleaner includes a suction head 10 for passing foreign substances laden air therethrough and a casing 20 connected to the suction head 10.

The casing 20 includes a dust chamber 22 having a dust bag 24 for capturing coarse foreign substances from the foreign substance laden air, an appliance chamber 26 having a fan motor assembly 30 for generating a suction force and a cord chamber 40 for storing an electrical cord 42, these chambers 22, 26 and 40 being separated by respective partitions 44, 46 and 48.

The dust chamber 22 is located in the front portion of the casing 20, and the appliance chamber 26 and the cord chamber 40 are disposed in the rear portion of the casing 20 behind the dust chamber 22 and separated by the partition 48.

The fan motor assembly 30 has a motor housing 32, an acoustically absorbent sleeve 34 installed around a periphery part of the motor housing 32 and a plurality of discharge openings 36 for discharging an air from the motor housing 32 to the appliance chamber 26 therethrough.

The partition 44 located between the dust chamber 22 and the appliance chamber 26 has an air suction opening 45 through which an air from the dust bag 24 flows to the fan motor assembly 30, and the partition 46 installed between the dust chamber 22 and the cord chamber 40 has an air hole 47 for an air communication therebetween.

Further, the casing 20 includes an exhaust filter 49 for filtering fine foreign substances from an air from the fan motor assembly 30 and a plurality of exhaust outlets 50 for discharging an air passing through the exhaust filter 49 outside.

The operation of the conventional vacuum cleaner will now be described.

When the vacuum cleaner is driven by inserting the electrical cord 42 to the plug(not shown) via a cord passage hole(not shown), the foreign substances laden air is suctioned to the dust bag 24 through the suction head 10 by means of the fan motor assembly 30 so that the coarse foreign substances are accommodated in the dust bag 24. Then, a portion of an air passing through the dust bag 24 is drawn to the fan motor assembly 30 via the air suction opening 45 and then discharged to the appliance chamber 26 via the discharge openings 36. When the air is discharged through the discharge openings 36, the noise is generated but is reduced by the acoustically absorbent sleeve 34. Thus discharged air is purified by the exhaust filter 49 and finally discharged outside the vacuum cleaner through the exhaust outlets 50. The remaining air passing through the dust bag 24 flows inside the cord chamber 40 via the air hole 47 to cool the electrical cord 42.

In such a configuration, the air for cooling the electrical cord flows from the dust chamber to the cord chamber through the air hole directly to be discharged to outside via the cord passage hole. In other words, since the air is discharged without being purified by the exhaust filter, insanitary foreign substances are discharged to outside and an unpleasant odor is generated.

Further, it is impossible to cool heating elements other than the electrical cord.

SUMMARY OF THE INVENTION

It is, therefore, an object of the present invention to provide a vacuum cleaner capable of cooling various heating element and reducing the noise by diverging a flow of an air passing through an exhaust filter.

In accordance with a preferred embodiment of the present invention, there is provided a vacuum cleaner including: A vacuum cleaner including: a main body; a motor assembly installed at the main body, the motor assembly including a motor for generating a suction force; an exhaust filter for filtering fine foreign substances from air passing through the motor assembly; and a guide member for guide a portion of air going via the exhaust filter to the inside of the main body.

BRIEF DESCRIPTION OF THE DRAWINGS

The above and other objects and features of the present invention will become apparent from the following description of preferred embodiments, given in conjunction with the accompanying drawings, in which.

DETAILED DESCRIPTION OF THE PREFERRED EMBODIMENTS

A first preferred embodiment of the present invention will now be described with reference to FIGS. 2 to 4B.

Figure 1:
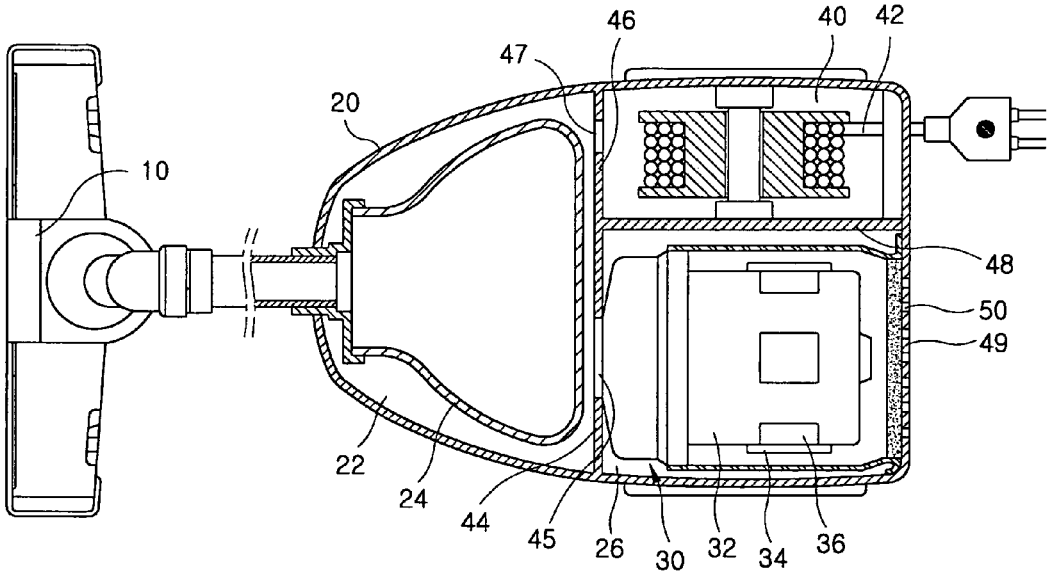
FIG. 1 (PRIOR ART)
FIG. 1 is a cross sectional view of a conventional vacuum cleaner.
Figure 2:
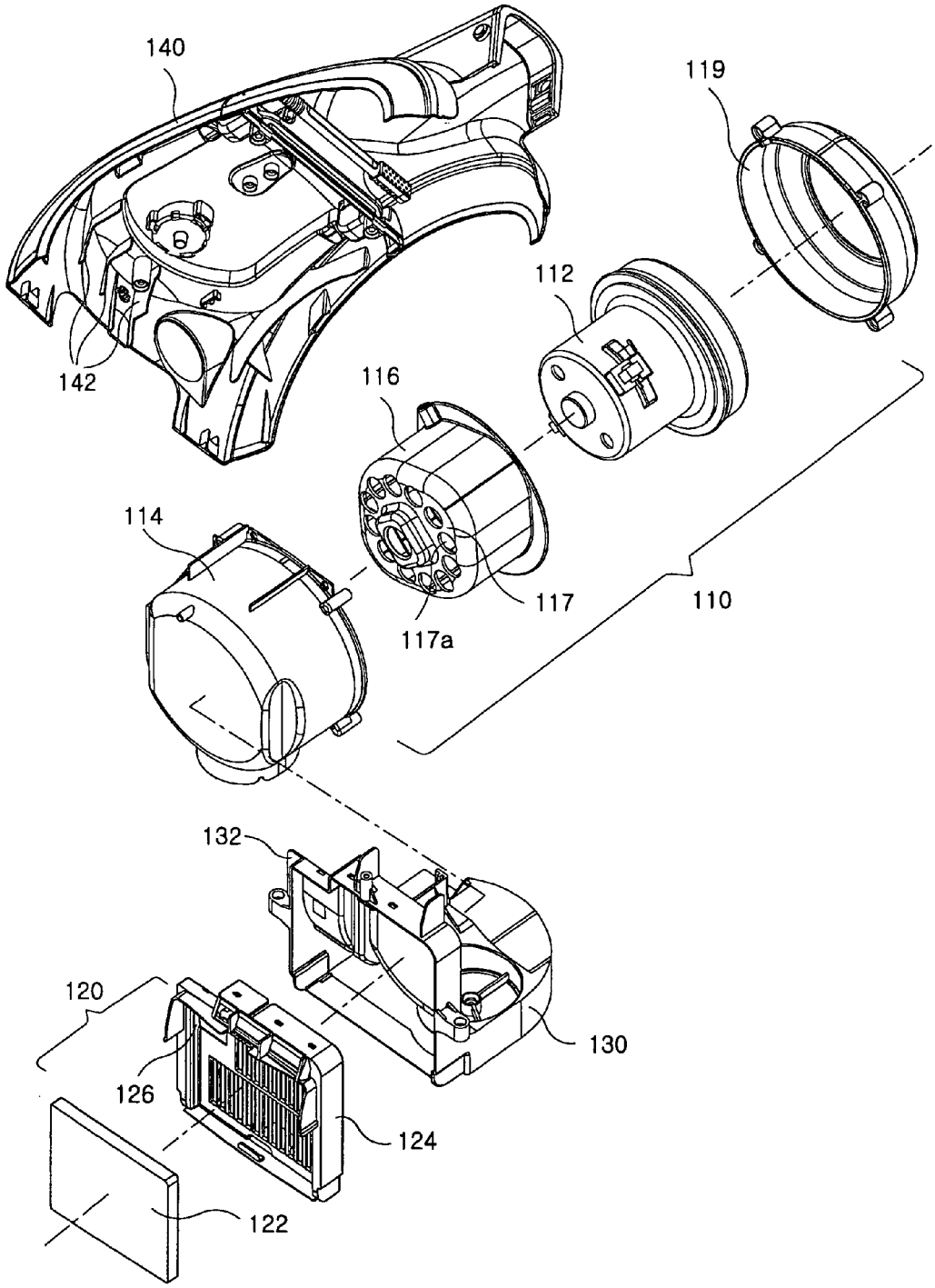
FIG. 2 shows an exploded perspective view illustrating major elements of a vacuum cleaner in accordance with the present invention.

Referring to FIG. 2, there is shown an exploded perspective view illustrating major elements of a vacuum cleaner in accordance with the present invention.

As shown, the vacuum cleaner includes a motor assembly 110, a filter assembly 120, a bracket 130 for fixing the motor assembly 110 and the filter assembly 120 to a vacuum cleaner main body (not shown), and a cover 140 for constituting top of the vacuum cleaner main body.

The motor assembly 110 has a motor 112 for generating a suction force, a housing 114 for mounting the motor 112 therein, and a sound-absorbing case 116. The sound-absorbing case 116 is installed in the housing 114 in such a manner as to surround a cylindrical body of the motor 112. After the motor 112 and the sound-absorbing case 116 are installed in the housing 114, the housing 114 is closed by a cap 119. The sound-absorbing case 116 with a bottom wall 117 has a circular shape in section of a diametrical direction and a U-shape in section of a longitudinal direction (see FIG. 4A). To further improve the sound-absorbing efficiency, the sound-absorbing case 116 can have at its inner periphery a sound-absorbing material, e.g., a felt. Further, the bottom wall 117 of the sound-absorbing case 116 has a plurality of air passing holes 117*a* for passing an air purified by a main filter(not shown) therethrough. The air passing holes 117*a* are equally spaced apart from each other in a circumferential direction of the bottom wall 117. Furthermore, each of the diameters of the air passing holes 117*a* becomes smaller as it goes to a bottom of the bottom wall 117. In other words, their diameters become smaller gradually along an air flow direction(see FIG. 4A).

The filter assembly 120 has an exhaust filter 122, provided at a rear portion of the vacuum cleaner main body, for filtering fine foreign substances from the air passing through the air passing holes 117*a* and a filter plate 124 for mounting the exhaust filer 122 thereat. The filter plate 124 has an opening 126 through which a portion of air from the exhaust filter 122 passes inward the vacuum cleaner main body, e.g., where a cord reel 150 for holding an electrical cord for supplying a power to the vacuum cleaner, is disposed as will be described.

At one side of the bracket 130 is installed the housing 114 incorporating therein the motor 112 and at the other side thereof is mounted the filter plate 124 where the exhaust filter 122 is installed. Furthermore, the bracket 130 has a guide portion 132 for guiding the air via the opening 126 toward the cord reel 150.

The cover 140 has at its rear portion a plurality of vertical guide ribs 142 for guiding a portion of air from the exhaust filter 122 toward top of the vacuum cleaner main body.

Figure 3A:
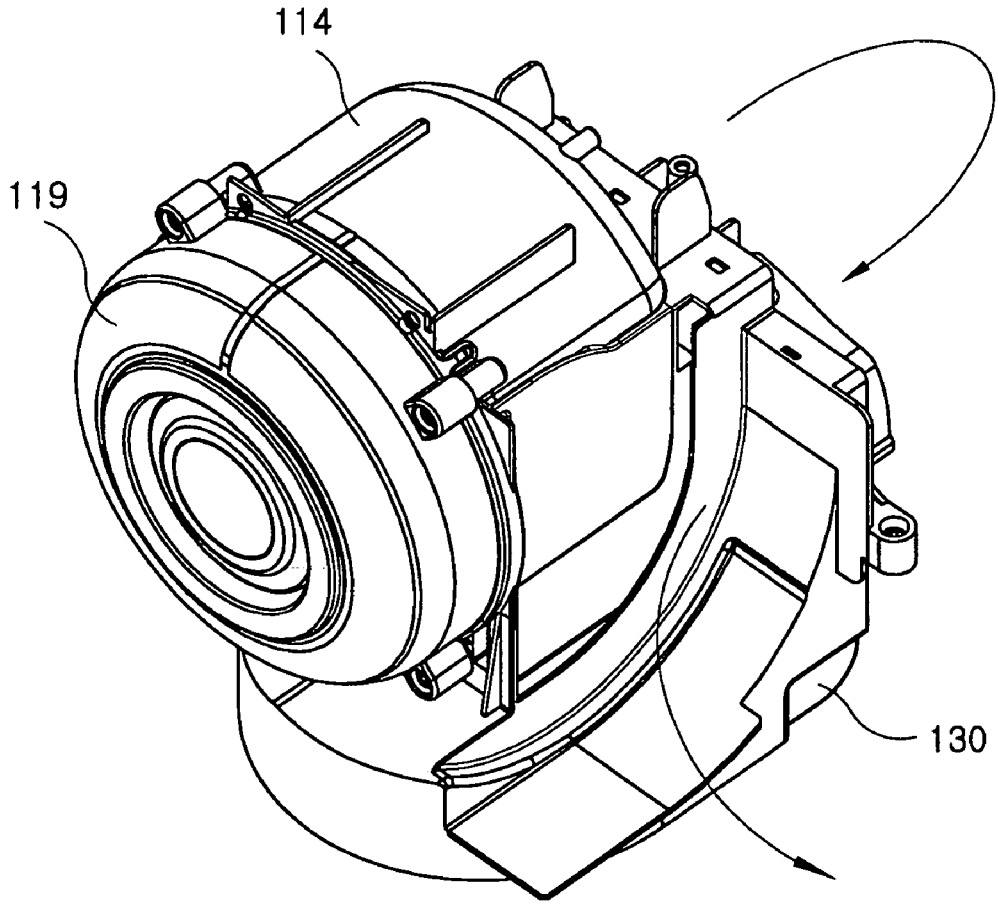
FIGS. 3A and 3B illustrate a perspective view of a structure where a motor assembly and a bracket in accordance with the present invention are assembled and a perspective view for describing an assembly of the structure shown in FIG. 3A and a cord reel in accordance with the present invention, respectively.
Figure 3B:
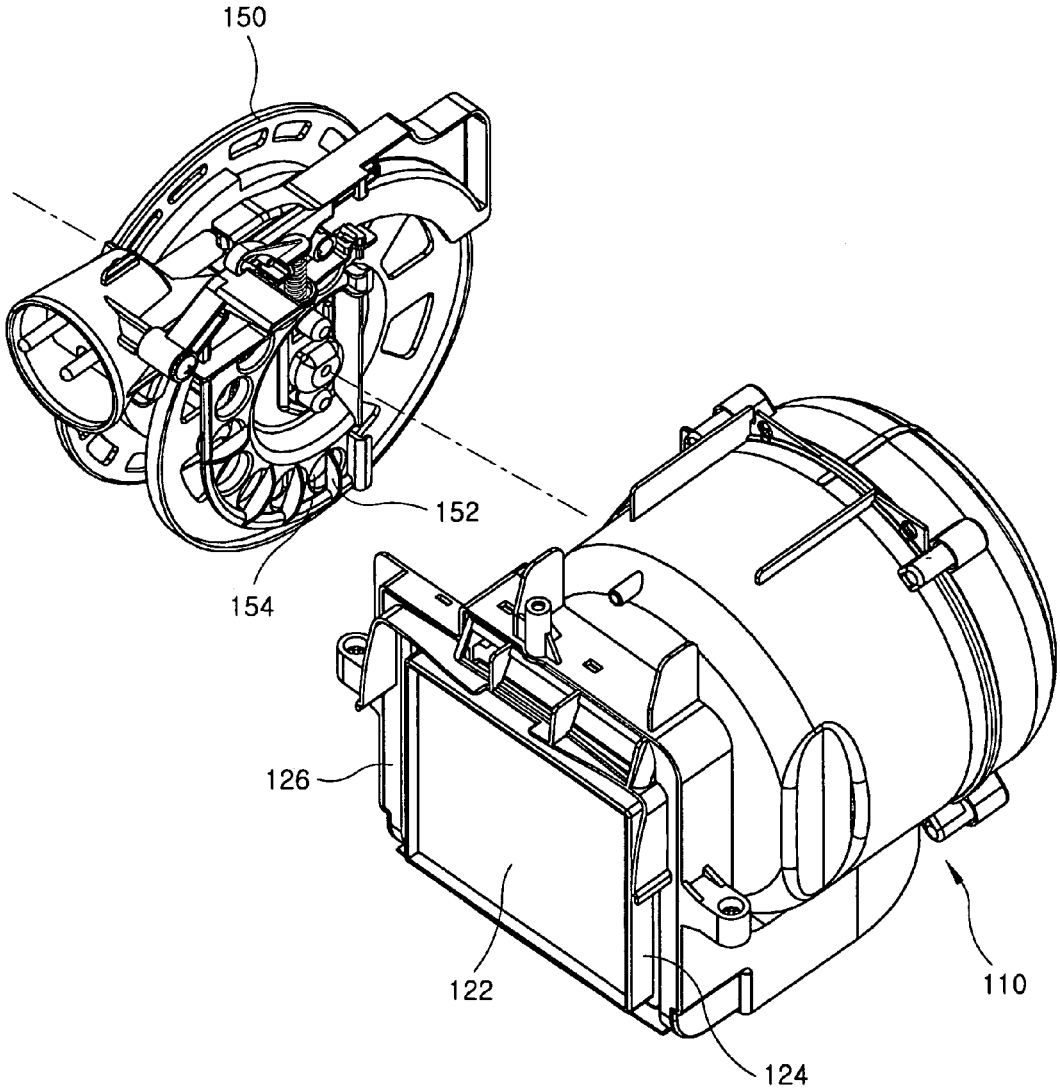

There are respectively shown in FIGS. 3A and 3B an airflow as indicated by an arrow in a structure where the motor assembly 110, the filter assembly 120 and the bracket 130 are assembled with each other, and an exploded perspective view illustrating a connection of the cord reel 150 to the structure. As shown in FIG. 3B, the cord reel 150 is installed at one side of the motor assembly 110.

Referring to FIGS. 2, 3A and 3B, a portion of air passing through the exhaust filter 122 is guided to the cord reel 150 via the opening 126 by the guide portion 132 of the bracket 130 to cool the electrical cord. As shown in FIG. 3B, the cord reel 150 has through-holes 154 for passing the air guided by the guide portion 132 therethrough and curved ribs 152, each of which is disposed in the vicinity of each of the through-holes 154, for efficiently guiding the air from the guide portion 132 to the through-holes 154.

The airflow in the vacuum cleaner in accordance with the present invention will now be described.

When the motor 112 is driven to generate the suction force, foreign substances laden air is suctioned and the foreign substances such as dirt are filtered by, e.g., the main filter. The air passing through the main filter is guided inside the housing 114 of the motor 112 and goes via the sound-absorbing case 116 surrounding the cylindrical body of the motor 112. Therefore, the noise of the motor 112 is reduced by the sound-absorbing case 116. In case the sound-absorbing material is attached on the inner periphery of the sound-absorbing case 116, the seal of the motor 112 is further improved. Thereafter, the air passes through the air passing holes 117*a*. At this time, since each of the air passing holes 117*a* has the gradually decreasing diameter as above described, the velocity of the air becomes greater gradually. As a result, the sound wave generated by thus greater air velocity becomes greater as well and its frequency is changed from the low frequency to the high frequency. Since the sound wave with the high frequency is generally reflected easier than that with the low frequency by an object, thus exchanged high frequency sound wave is reflected by the housing 114 to be attenuated. This allows the noise to be transmitted to the outside of the vacuum cleaner to be reduced.

Figure 4A:
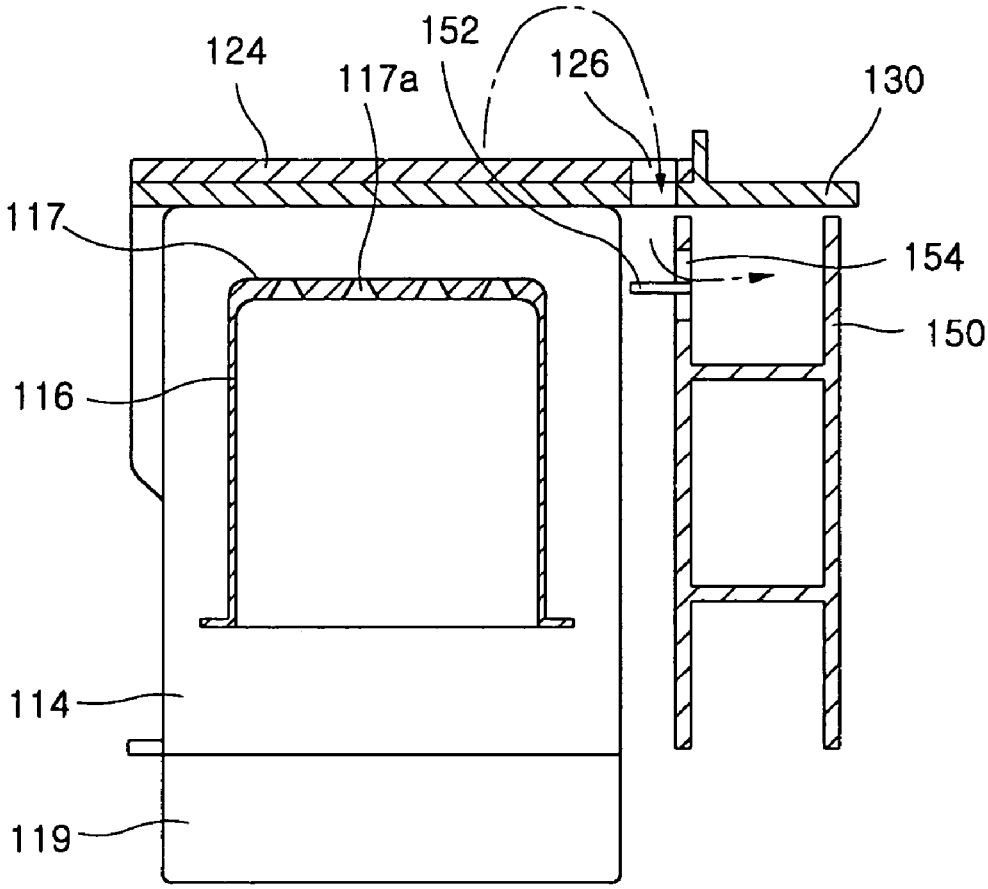
FIGS. 4A and 4B depict cross sectional views setting forth flows of air in accordance with the present invention.

Next, an air passing through the sound-absorbing case 116 is discharged to go via the bracket 130 and the exhaust filter 122 installed at the filter plate 124. While the air passes through the exhaust filter 122, the fine foreign substances are filtered therefrom. Thereafter, a portion of the air from the exhaust filter 122 passes through the opening 126 formed at the filter plate 124 to be turned toward the cord reel 150 by the guide portion 132 of the bracket 130 as shown in FIG. 4A. Thus turned air is guided to the through-holes 154 by the ribs 152 and passes therethrough to cool an electric cord.

Figure 4B:
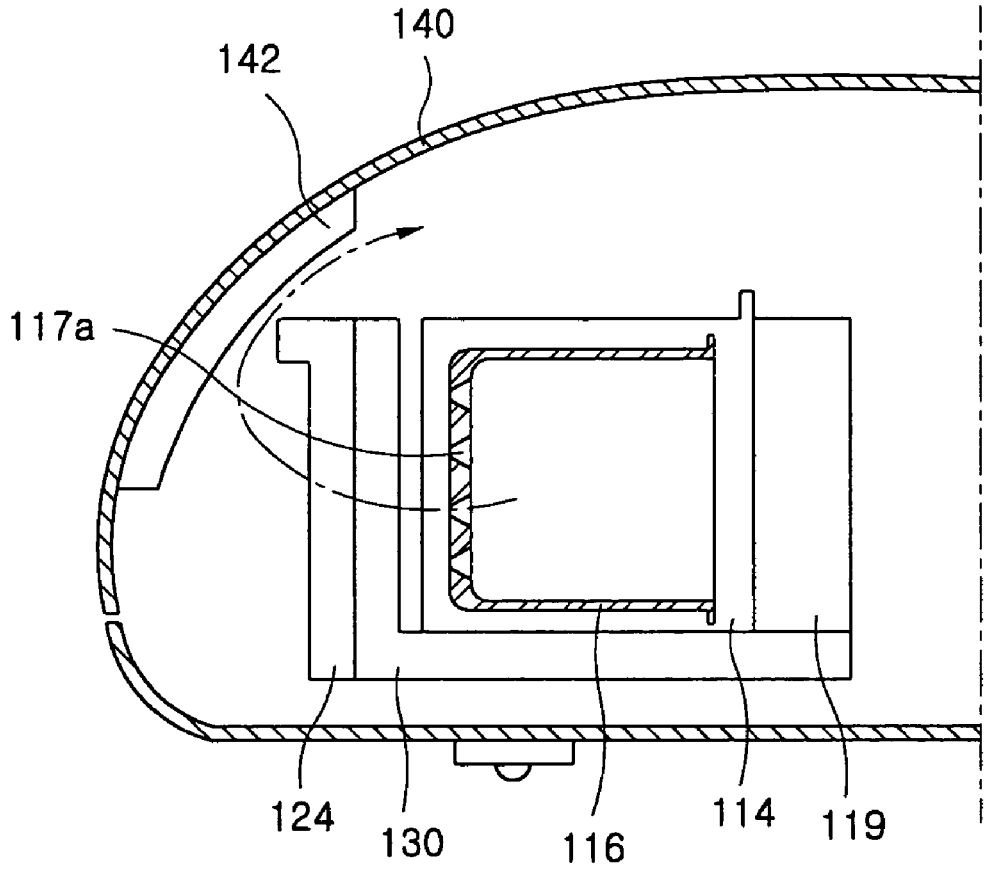

As shown in FIG. 4B, another portion of the air from the exhaust filter 122 installed at the filter plate 124 is guided by the vertical guide ribs 142 to be turned toward top of the bracket 130, specifically top of the housing 114 where a plurality of electric components is installed. This permits the components to be cooled.

Still another portion of air from the exhaust filter 122 is discharged to outside of the vacuum cleaner via an air outlet (not shown).

As above explained, after the air suctioned by the motor passes through the exhaust filter, the partial air is guided to the cord reel 150 by the opening 126 and the guide portion 132 to cool the electrical cord and simultaneously another partial air is guided to top of the housing 114 to cool the electric components. Further, by diverging the flow of the air from the exhaust filter, it is possible to reduce the noise of the vacuum cleaner.

While the invention has been shown and described with respect to the preferred embodiments, it will be understood by those skilled in the art that various changes and modifications may be made without departing from the spirit and scope of the invention as defined in the following claims.

What is claimed is:

1. A vacuum cleaner comprising:

a main body;

a motor assembly installed at the main body, the motor assembly including a motor for generating a suction force;

an exhaust filter for filtering fine foreign substances from air passing through the motor assembly;

a guide member for guiding a plurality of portions of air from the exhaust filter to the inside of the main body; and a sound-absorbing case for reducing the noise of the motor, wherein the sound-absorbing case is installed in the housing to surround a cylindrical body of the motor and has a plurality of air passing holes for passing an air from the motor therethrough, and wherein diameters of the air passing holes become smaller gradually along an air flow direction.

2. The vacuum cleaner of claim 1, wherein the guide member includes a horizontal guide member and a vertical guide member for guiding first and second portions of the plurality of portions of air passing through the exhaust filter to the side and the top of the main body respectively.

3. The vacuum cleaner of claim 1, further comprising a cord reel configured to hold an electrical cord for supplying a power to the vacuum cleaner and a plurality of electric components, wherein the guide member guides the plurality of portions of air passing through the exhaust filter to the cord reel and the electric components.

4. The vacuum cleaner of claim 3, wherein the cord reel is installed at one side of the motor and the electric components are disposed at a top portion inside the main body.

5. The vacuum cleaner of claim 4, wherein the cord reel includes a number of through-holes for passing a second portion of the plurality of portions of air guided by the guide member therethrough and a plurality of curved ribs for guiding the second portion of the air to respective through-holes.

6. The vacuum cleaner of claim 4, further comprising a cover defining a top of the main body, wherein the cover is provided with a plurality of vertical guide ribs.

7. The vacuum cleaner of claim 1, wherein the air passing holes are equally spaced apart from each other in a circumferential direction of a bottom wall of the sound-absorbing case.

8. A vacuum cleaner comprising:

a main body;

a motor, installed at the main body, for generating a suction force;

an exhaust filter, provided at a rear portion of the main body, for filtering fine foreign substances from air passing through the motor;

a sound-absorbing case for reducing the noise of the motor;

a housing for mounting the motor and the sound-absorbing case therein;

a filter plate for installing the exhaust filter thereon;

a bracket for fixing the housing and the filter plate to the main body; and a guide unit for guiding a plurality of portions of air from the exhaust filter to the inside of the main body.

9. The vacuum cleaner of claim 8, wherein the guide unit includes a guide portion horizontally extending from the bracket for guiding a first portion of the plurality of portions of air passing through the exhaust filter to a side portion of the main body, and an opening formed at the filter plate, wherein the opening guides the first portion of air from the exhaust filter to the side portion of the main body.

10. The vacuum cleaner of claim 9, wherein the guide unit further includes a cover defining a top of the main body, the cover having a plurality of vertical guide ribs for guiding a first portion of the plurality of portions of air passing through the exhaust filter to a top portion of the main body.

* * * * *